United States Patent [19]

Rasmussen

[11] 4,434,642

[45] Mar. 6, 1984

[54] REVERSE FORGING OR REPLACEMENT GROUSER BARS

[75] Inventor: Robert Rasmussen, Rancho Palos Verdes, Calif.

[73] Assignee: Industrial Parts Depot, Torrance, Calif.

[21] Appl. No.: 268,906

[22] Filed: Jun. 1, 1981

[51] Int. Cl.[3] ..... B21D 22/00

[52] U.S. Cl. ..... 72/356; 72/358; 72/377; 305/53; 305/54; 29/148.3; 29/402.01; 29/402.16; 29/402.19

[58] Field of Search ..... 305/54, 53, 56; 72/356, 72/358, 359, 375, 376, 377; 29/148.3, 401.1, 402.01, 402.16, 402.19

[56] References Cited

U.S. PATENT DOCUMENTS

| | | | |
|---|---|---|---|
| 2,874,005 | 2/1959 | Engström | 305/54 |
| 2,964,361 | 12/1960 | Hansen | 305/54 |
| 4,021,082 | 5/1977 | Rasmussen | 305/54 |

*Primary Examiner*—Francis S. Husar
*Assistant Examiner*—David B. Jones
*Attorney, Agent, or Firm*—Beehler, Pavitt, Siegemund, Jagger & Martella

[57] ABSTRACT

A method for making replacement grouser bars particularly contoured to fit rock worn grouser shoes from blanks cut from inexpensive sheet metal. The blank has a straight lower edge and a curved upper edge such that the bar is thicker at the ends than in the middle. The straight lower edge is easily double beveled and the blank is reverse forged to obtain a finished grouser bar having a straight upper edge and a curved lower edge, the bar still being thicker at the ends than in the middle.

7 Claims, 10 Drawing Figures

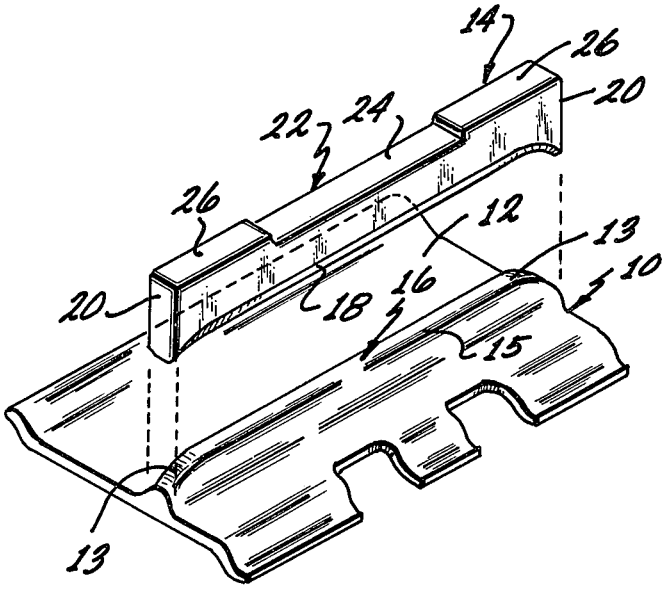
Fig. 1
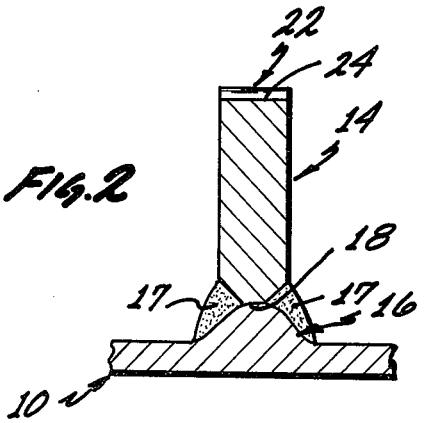
Fig. 2
Fig. 3
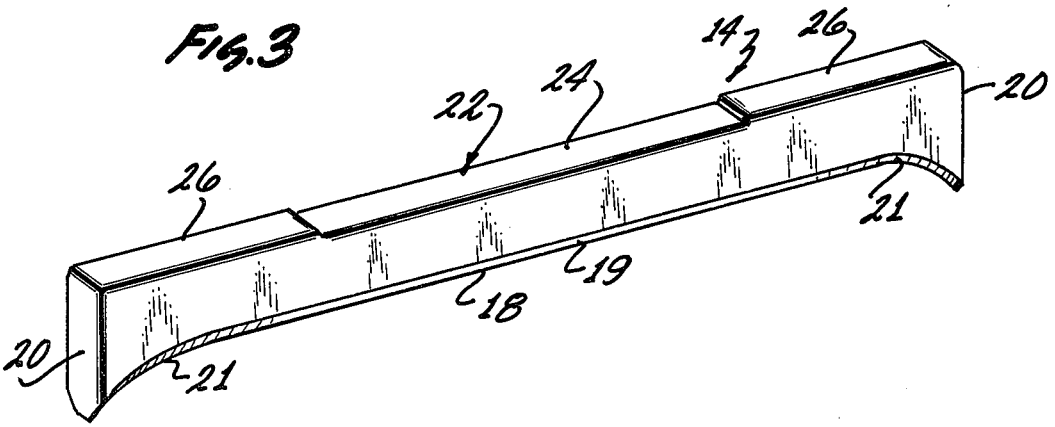

REVERSE FORGING OR REPLACEMENT GROUSER BARS

BACKGROUND OF THE INVENTION

1. Field of the Invention

This invention pertains generally to the field of grouser shoes making up the flexible track of a vehicle such as a crawler tractor or the like. More specifically, the invention relates to a method for manufacturing replacement grouser bars for rebuilding worn grouser shoes.

2. State of the Prior Art

A method for manufacturing replacement grouser bars is disclosed in U.S. Pat. No. 4,021,082 issued to applicant on May 3, 1977. The method taught in applicant's prior patent is useful for obtaining a smooth overall curvature of the grouser bar with a pair of downwardly extending tongs at either end. The tongs formed at the end of the grouser bar are obtained by applying inwardly directed lateral compressive force against the respective ends by means of ooposing pistons such that the ends are deformed within a die cavity to conform to a die enclosing the grouser blank. As a result of the compressive force, the ends of the blank are thickened in addition to being pushed downwardly to form the tong ends. The prior method is not particularly adapted to the manufacture of replacement grouser bars intended as replacements for grouser shoes worn in rocky terrain. "Rockworn" grousers exhibit a typical wear pattern wherein the central portion of the grouser is worn down but remains generally straight, while the ends of the grouser are worn off and sharply rounded. Thus, there is little, if any, curvature along the central portion of the worn grouser, and the curved contour of the replacement bars obtained by the prior method of applicant do not yield a good fit to such rock wear patterns. As a consequence, a great deal of weldment is required to fill the substantial gaps between the worn shoe and the replacement bar, making replacement time-consuming and expensive, as well as resulting in a compromise in structural reliability of the rebuilt grouser shoe.

SUMMARY OF THE INVENTION

The method of this invention overcomes the aforedescribed shortcomings in that the resultant replacement bar has a weld edge shaped to fit the typical rock wear pattern and in addition has an outer edge especially adapted for extended wear in rocky terrain where abnormal grouser end wear may be expected. Specifically, the replacement bar obtained by the method of this invention is optimized for use in rocky environment by the provision of raised shoulders at the ends of the grouser bar to provide additional material at the points where maximum wear occurs. The improved replacement bar is made by using tooling to be described. The tooling is also simplified and requires only a single vertically-displaceable ram head or anvil. No lateral pistons are required and the blank is not thickened at the ends. Instead, material is moved downwardly from the upper edge to the lower edge to produce dependent end portions on the lower edge with a straight intermediate portion. The present method is therefore more efficient in producing replacement grouser bars specifically contoured for easy welding to rockworn grouser shoes.

The present method is also more cost-effective in that the blanks are of a shape which may be cut from inexpensive, large sheets of steel by automated flame cutting methods, and then easily beveled along the straight lower edge. Also, the present method allows fabrication of replacement grouser bars with significant curvature to fit severely rockworn grouser shoes.

The method of this invention is practiced by forming a blank having a lower straight edge, a pair of upwardly converging side edges, and an upper edge having a straight central portion parallel to the lower edge and curving upwardly at the ends from the straight central portion to the converging side edges, such that the blank is wider at the ends than at the center. Preferably, the straight central portion of the upper edge is depressed to form a drop in the transition from the curved end portions of the upper edge to the straight central portion. The straight lower edge is beveled, preferably with a double bevel, and the blank is supported in a die having a V-shaped bottom conforming to the bevel of the lower edge so that the bevel is preserved. The bottom of the die is convexly curved along a line running from one end of the blank to the other so that initially the bottom of the die contacts only the center portion of the straight lower edge of the blank.

Downward force is then applied to the upper edge of the blank along a horizontal plane parallel to the straight lower edge, as by a planar anvil face driven by hydraulic means. Initially, the anvil face only contacts the vertically projecting tips of the upwardly curving end portions of the upper edge of the blank. These curving end portions are progressively forced downward into the space defined by the downwardly curving end portions of the bottom of the die and the end portions are deformed by the downward pressure until the upper edge is substantially straightened while the lower edge is concavely curved at the side or end portions to conform to the curvature of the end portions of the die bottom. The die has the proper arc so that the formed bar fits the worn shoe. As a consequence, the originally upwardly converging side edges of the blank become substantially parallel with each other and also perpendicular to the now-straightened edge of the bar.

It will be appreciated that little, if any, work has been done on the central portion of the blank which remains substantially unchanged in the finished grouser bar. The forgoing operation is carried out principally on the end portions of the bar.

BRIEF DESCRIPTION OF THE DRAWINGS

FIG. 1 is a perspective view of a worn grouser show and a replacement bar made by the method of the present invention adapted to fit thereon;

FIG. 2 is an elevational cross section of a grouser bar welded to a worn shoe;

FIG. 3 is an enlarged perspective view of a replacement grouser bar made by the method of this invention;

DETAILED DESCRIPTION OF THE INVENTION

Figure 4:
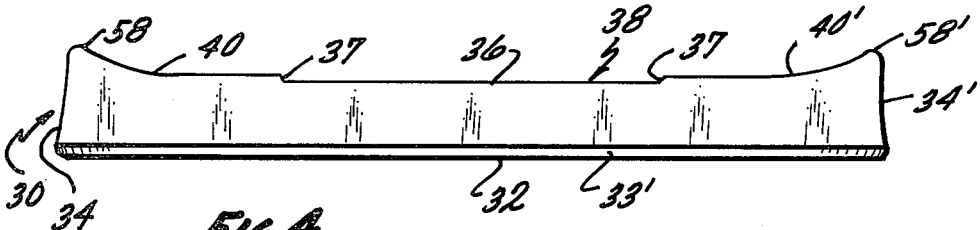
FIG. 4 shows in front elevational perspective a blank for processing into a replacement grouser bar.
Figure 4A:
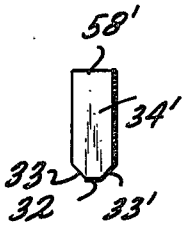
FIG. 4A is a side elevational view of the blank of FIG. 4.
Figure 5:
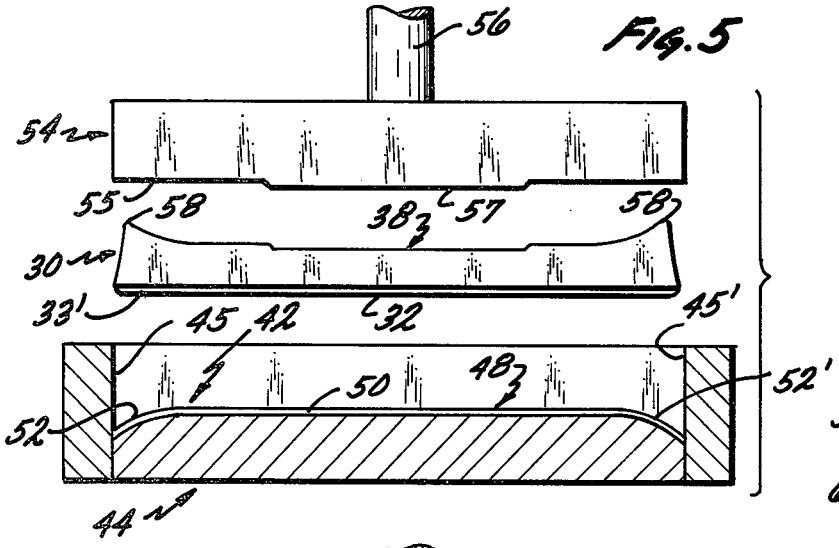
FIG. 5 shows in exploded elevational front perspective the blank of FIG. 4 positioned between the forming die at the bottom and the moving anvil at the top.
Figure 6:
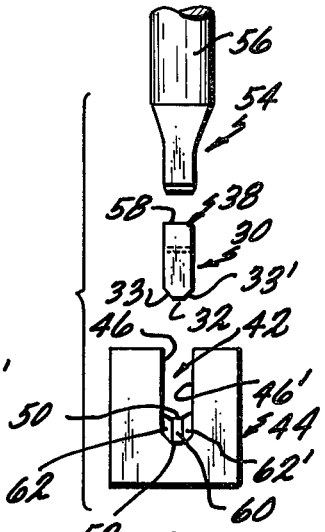
FIG. 6 is a side view of the exploded arrangement of FIG. 5.

With reference to FIG. 1 of the drawings, a typical grouser shoe 10 is one of a plurality that would be interconnected to make up the flexible track of a vehicle such as a bulldozer or a crawler tractor. The grouser shoe includes a relatively flat area 12 having means for attaching it to a track chain or radial assembly upon the vehicle thereby facilitating a controlled relative movement between adjacent paths. The primary purpose of the pad area is to provide flotation of the vehicle on the terrain.

A bar 16 is affixed transversely across the pad area 12 and extends outwardly from and approximately perpendicularly thereto. These grouser bars 16 lie transversely to the line of movement of the vehicle and are forced down into the terrain by the weight of the vehicle and provide traction for forward or backward movement of the tractor. The grouser bar is the first portion of the shoes subjected to serious wear, particulary when the equipment is operating in hard or rocky terrain. Since a tractor usually utilizes 62 to 86 grouser shoes, and grouser shoes are extremely expensive, it is the normal and desirable practice to replace worn bars by welding new bars to the pads, thereby increasing the shoe life. Such a worn grouser shoe is illustrated in FIG. 1, along with a replacement grouser bar 14 for welding to the original worn-off bar 16.

Grouser shoes used extensively in rocky terrain exhibit a characteristic wear pattern, characterized by a relatively even wear along the major central portion 15 of the grouser bar 16, and sharply rounded off at the ends or corners 13 where maximum abrasion takes place. The method of the present invention, therefore, discloses a method for manufacturing grouser bars contoured for easy replacement of rockworn grouser and having an upper working edge shaped for optimum wear in rocky terrain.

FIG. 2 shows in elevational cross section the typical manner of replacement of worn grouser shoes. The replacement grouser bar 14 is fitted over the worn grouser bar 16 and the space defined between the lower beveled edge of the replacement bar and the worn grouser bar 16 is filled with weldment 17.

A finished replacement grouser bar produced by the method of this invention is shown in FIG. 3. The grouser bar 14 has a lower edge 18 which is beveled for welding to the worn grouser shoe. The lower edge 18 is substantially straight along a major central portion 19 thereof and curves downwardly at both ends 21 to conform to the rounded-off corners of the typical rock grouser wear pattern. The replacement bar has a pair of straight vertical side edges 20 which are generally parallel to each other and perpendicular to the upper edge 22 of the grouser bar. The upper edge includes a straight horizontal central portion 24 intermediate two raised horizontal end portions or shoulders 26 which provide added grouser wear against the extreme abrasion at corners typical of rock wear.

The novel method of manufacture of the grouser bar of FIG. 3 is shown in three sequential steps in FIGS. 4 through 7.

In FIG. 4, a blank 30 is first formed as by flame cutting of a sheet of steel, or other suitable means to the shape shown. The blank is of uniform thickness and has a straight lower edge 32, a pair of upwardly converging preferably concavely curved side edges 34 and 34' and an upper edge 38 having a straight horizontal central section 36 parallel to the lower edge 32. The upper edge 38 also includes concavely curved end sections 40 and 40' curving upwardly from the central section 36 towards the respective side edges 34 and 34'. The center section 36 is preferably depressed with respect to the curved end sections 40, 40' to form a step 37 at the transition points to the end sections.

The lower straight edge 32 is then double-beveled as by flame cutting, or machining, or grinding to form opposed bevel surfaces 33, 33'. The bevel surfaces together with the rounded cross-sectional contour of the worn grouser bar define elongated recesses which are filled with weldment in the grouser replacement operation, as illustrated in cross section in FIG. 2.

The blank 30 is heated to a suitable temperature and is then placed in a die cavity 42 defined by a die 44. The die cavity 42 is closed at the ends by end walls 45, 45' and is further bounded by a pair of vertical walls 46, 46'. The lower edge 32 of the blank is supported by the bottom of the die 48 and extends substantially the full distance between end walls 45, 45' of the die cavity. The die bottom 48 includes along its length a straight horizontal central section 50 and is curved convexly at each end so that the bottom curves downwardly away from the central section 50 at the end or side portions 52 and 52'. The cross section taken along the width of the die bottom 48 in FIG. 6 between the walls 46, 46' is generally V-shaped to accommodate and preserve the beveled lower edge of the blank during the forging step and includes a horizontal bottom surface 60 joined to the vertical walls 46, 46' by the outwardly slanting surfaces 62, 62' respectively. Thus, when the blank 30 is placed within the die cavity 42, the lower edge 32 of the blank is supported only along the straight central section 50 of the die bottom 48.

Figure 7:
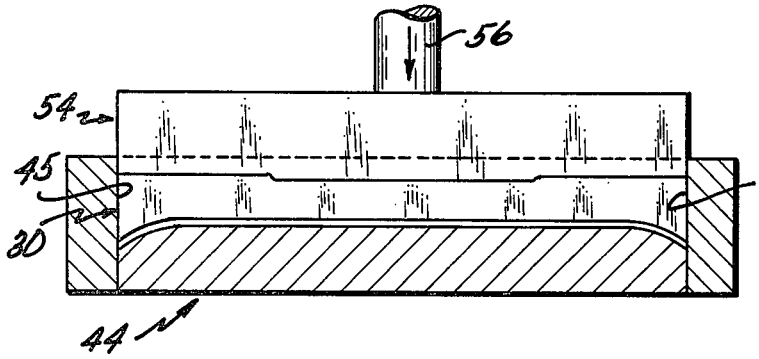
FIG. 7 shows the formed grouser bar in the die following the forging operation.
Figure 8:
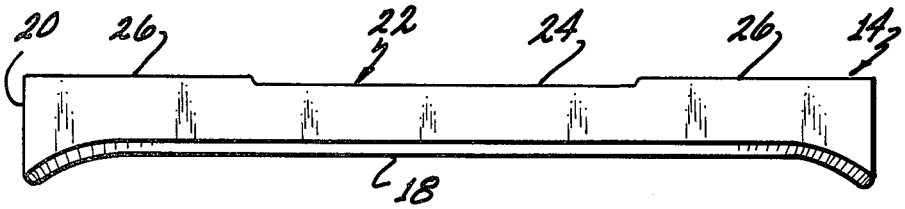
FIG. 8 is a front elevational view of the finishd grouser bar.
Figure 8A:
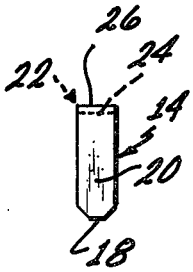
FIG. 8A is a side elevational view of the finished grouser bar of FIG. 8.

An anvil or ram head 54 is mounted at the end of a vertically displaceable ram 56 for applying downwardly directed force against the upper edge 38 of the blank. The anvil 54 is provided with a lower face 55 which is substantially straight and horizontal and is parallel to the bottom edge 32 of the blank supported within the die cavity 42. A raised central portion 57 on the anvil face 55 mates with the depressed central portion 36 of the blank to preserve the same. Downward force is therefore applied along the horizontal plane defined by the anvil face 55 and is first applied to the tips 58 formed by the intersection of the side edges 34, 34' and the upwardly curving side or end portions 40, 40' of the blank respectively. As the ram moves the anvil 54 downwards, the end portions of the blank 30 are forced into the space defined by the downwardly aloping portions 52, 52' of the bottom of the die and gradually the area of contact between the upper edge of the blank and the anvil face 55 extends inwardly from the tips 58 until full contact is established along the upper edge 38 of the blank. At that point, the upper edge 38 is substantially straightened while the side portions of the lower beveled edge 32 have been concavely curved to conform to the downward slope of the bottom of the die. This so-called "reverse forging" also cause the upwardly converging side edges 34, 34' to become parallel to each other as seen in FIG. 7 and perpendicular to the straightened upper edge 38 of the blank to form a finished replacement grouser bar having the desired configuration of FIG. 3. The initial conacvity of the side edges 34, 34' is filled out by outwardly flowing metal which is molded against the straight vertical side walls 45, 45' of the die cavity as the end portions are deformed downwardly by the descending anvil 54, such that these edges become substantially straight as seen in FIGS. 7 and 8.

In the method of this invention, little if any work is done on the central portion of the blank defined by the straight central portion 36 of the upper edge and the thickness of the finished grouser bar 14 in FIG. 4 is uniform along its length and substantially the same as that of the blank 30 in FIG. 4. The forging operation works to reverse the shape of the ends of the blank relative to the center from an initially upwardly curving to a finally downwardly depending shape. By commencing the process with a straight lower edge terminating in obtuse angled corners on the blank 30 it is possible to economically form the necessary double bevel on the lower edge, and yet finish with a curved beveled edge.

As a result, the blanks can be cut from inexpensive sheet metal instead of the costlier rolled bar stock with a rolled bevel used in the method of the prior art.

The straight center section 36 is preferably depressed in order to conserve material and reduce the mass of the replacement bar. This is possible in grouser bars intended for use in rocky terrain, because the ends wear at a considerably greater rate than the center. It is thus possible to reduce the amount of material in the center of the bar without shortening the useful life expectance of the grouser bar. Conversely, the service of the bar may be extended by building up only the end portions of the grouser bar.

After forging, the bar may be processed as described in U.S. Pat. No. 4,021,082 by differential heat treating for a soft weld zone and a hardened work face.

Various changes and substitutions in the described embodiment will be apparent to those skilled in the art without departing from the spirit and scope of the invention. Therefore, applicant intends to be bound only by the claims which follow.

What is claimed is:

1. A method of making a replacement grouser bar having a straight upper edge and a curved lower edge with end portions wider than the center comprising the steps of:

forming a blank having a concavely curved upper edge and a straight lower edge with the ends wider than the central portion;

beveling said straight lower edge;

supporting said blank in a die defining a die cavity having a bottom, said bottom having a straight horizontal central portion and downwardly curving side portions, said bottom further being V-shaped in width to preserve said bevel on said lower edge;

applying downward force to said upper concavely curved edge along a horizontal plane parallel to said straight lower edge whereby said curved upper edge is substantially straightened and said beveled straight lower edge is curved to conform to the downward curvature of said die bottom.

2. The method of claim 1 wherein said forming step further comprises forming:

a pair of upwardly converging side edges;

a straight central portion on said upper edge, said central portion being parallel to said straight lower edge, and end portions on said upper edge curving upwardly from said central portion towards said upwardly converging side edges.

3. The method of claim 2 wherein said forming step comprises the step of depressing said straight central portion of said upper edge with respect to the upwardly curving end portions, thereby obtaining a straight horizontal raised shoulder at each end upon straightening said upper edge by means of said step of applying downward force.

4. The method of claim 1 wherein said beveling step comprises the step of forming a double bevel on said straight lower edge.

5. The method of claim 1 wherein said step of applying downward force comprises the step of applying downward force with a ram head having a generally planar lower face parallel to said straight lower edge of said blank.

6. The method of claim 3 wherein said step of applying downward force comprises the step of applying downward force with a ram head having a generally planar lower face parallel to said straight lower edge of said blank, said planar face being provided with a raised central portion adapted to mate with said depressed central portion of said upper edge to thereby preserve said depression in the grouser bar.

7. The method of claim 2 wherein said forming step further comprises forming said upwardly converging side edges with a concave curvature, said side edges being substantially straightened by being pressed against said vertical end walls of said die cavity.

* * * * *